US009540833B2

(12) United States Patent
Mohammadi et al.

(10) Patent No.: US 9,540,833 B2
(45) Date of Patent: Jan. 10, 2017

(54) COVER DEVICE AND BLANKET FOR COVERING LIQUID SURFACES

(71) Applicants: Pedram Mohammadi, Kistarcsa (HU); László Hermann, Budapest (HU)

(72) Inventors: Pedram Mohammadi, Kistarcsa (HU); László Hermann, Budapest (HU)

( * ) Notice: Subject to any disclaimer, the term of this patent is extended or adjusted under 35 U.S.C. 154(b) by 0 days.

(21) Appl. No.: 14/889,216

(22) PCT Filed: May 6, 2014

(86) PCT No.: PCT/HU2014/000039

§ 371 (c)(1),
(2) Date: Nov. 5, 2015

(87) PCT Pub. No.: WO2014/181142

PCT Pub. Date: Nov. 13, 2014

(65) Prior Publication Data

US 2016/0108633 A1 Apr. 21, 2016

(30) Foreign Application Priority Data

May 9, 2013 (EP) ..... 13462002

(51) Int. Cl.
*E02B 3/00* (2006.01)
*E04H 4/08* (2006.01)
*B65D 88/36* (2006.01)
*B65D 88/34* (2006.01)

(52) U.S. Cl.
CPC ..... *E04H 4/08* (2013.01); *B65D 88/34* (2013.01); *B65D 88/36* (2013.01)

(58) Field of Classification Search
USPC ..... 405/52, 303; 126/561–568
See application file for complete search history.

(56) References Cited

U.S. PATENT DOCUMENTS 2,444,351 A * 6/1948 Hofberg ..... H01F 27/14 174/12 R
2013/0121766 A1* 5/2013 Birger ..... A63H 23/10 405/52

* cited by examiner

*Primary Examiner* — Sean Andrish
(74) *Attorney, Agent, or Firm* — Dowell & Dowell, PC

(57) ABSTRACT

The present invention relates to a self filling cover device for covering a surface of a liquid, having a shell (2) defining inner cavity, and the inner cavity is to be filled at least partly with liquid, so that the inner cavity is divided in at least two chambers (3,4) by a separating means (5,51,52), and one of the chambers (4) is provided by at least one opening (6) formed in the shell (2).

8 Claims, 4 Drawing Sheets

COVER DEVICE AND BLANKET FOR COVERING LIQUID SURFACES

BACKGROUND

Field of the Invention

The invention relates to a cover device for covering particularly open liquid surfaces, such as ponds, lakes or pools, having a shell defining an inner cavity, and the inner cavity is filled at least partly with a liquid. The invention also relates to a blanket formed by several cover devices according to the invention on the surface of a pond or pool.

Brief Description of the Related Art

Different kinds of open air industrial ponds need to be covered to prevent e.g. sunlight penetration and consequent algae formation or growing weeds, liquid loss through evaporation, to maintain higher water temperature in winter, or waterfowl fatalities in cases of both hazardous liquids stored and airport fire water ponds situated near the runways attracting fowls in the vicinity of air-bound planes. A very conventional solution has been netting. Published patent document US 2012285106 (A1) discloses a bird deterrent for preventing birds from flying into a reflective surface e.g. a glass surface, comprising a mesh having a first portion and a second portion, first and second support beams coupled to the first and second portions, respectively; first and second sets of suction cups coupled to the first and second support beams, respectively; and wherein the first and second sets of suction cups are slidably coupled to the first and second support beams, respectively, and configured to removably attach to a glass surface. It is clear, however, using this solution in case of a large liquid surface, like a pond or pool, is too expensive to build and maintain and will obviously be damaged by winter storms, and yet fails to camouflage the liquid surface from waterfowls.

Published Chinese utility model CN 202555020 discloses a full-light covered top type device for a mud storing pond. The device mainly solves the problem that an existing mud storing pond cannot normally operate due to freezing in winter and is characterized in that top beams are connected with the top of a vertical column, the top beams in arc shapes are parallel to each other, evenly distributed, and connected through transverse beams, and the outer surfaces of the top beams are covered by sunlight plates. Although this full-light covered top type device for the mud storing pond is strong in cold resistance capacity, it is very expensive to establish and is alien from an ideal heat insulating and bird repelling solution as well.

These problems have been attempted to solve by floating ball blankets providing a highly effective solution to difficult liquid storage problems above mainly in petrochemical, metal treatment and air-transport industries (see: www.euro-matic.com). By placing a sufficient quantity of hollow plastic balls onto the surface of a liquid, the balls automatically arrange themselves into a close packed formation. In a single layer on the liquid surface they virtually cover over 91% of the surface area, greatly reducing sunlight penetration and therefore liquid evaporation. The thermal insulating qualities of such balls also assist in maintaining winter operating temperatures of the water. Such a high surface coverage provides an extremely effective barrier and significantly reduces the mass and heat transfer mechanisms operating between the liquid and surrounding environment. A thermal insulation barrier is achieved through the air held in each ball and the poor heat conductivity of plastic. The air pockets between the balls, although not sealed, also contribute to this cellular insulation system which dramatically reduces heat loss. The low liquid surface area exposed to atmosphere dramatically reduces liquid loss through evaporation, odor release to the atmosphere and also conversely prevents surface absorption of oxygen.

Yet a blanket of balls presents no impediment to product dipping or equipment which has to move through the liquid surface; the balls are pushed aside, but quickly reform their cover as the equipment moves forward or products are lifted away from the tank. The balls rise and fall with liquid level within ponds or storage tanks, and also provide a constant cover over liquids held in reservoirs with sloping sides. If the liquid level falls, causing the surface area to shrink, the balls simply stack in a double layer; they automatically spread themselves into a single layer again as the level rises.

However, this blanket of cover balls has some disadvantages. In almost all open air industrial applications the balls consisting the covering blanket may drift into a limited surface area of the pond, due to strong or even stormy winds, or they might also be blown out from the pond. This phenomenon can be eliminated by applying balls partly filled with a liquid, e.g. water, but both producing and transporting of balls filled at least partly with water incur extended costs.

SUMMARY

Therefore, the object of the present invention is to provide a cover means or device for covering, particularly but not exclusively, open air industrial ponds, which overcomes the drawbacks of the solutions according to the state of the art, that is, when it takes part of a covering blanket on the surface of a liquid in a pond or pool, does not drift into a limited surface area, or be blown out from the pond or pool in case of strong or stormy winds, and does not require to be produced and transported in a state at least partly filled with a liquid, e.g. water, but it is simple to transport and to install as well as maintenance free.

This object has been achieved by providing a cover device for covering open liquid surfaces, such as ponds, lakes or pools, having a shell defining inner cavity, and the inner cavity is to be filled at least partly with liquid, and the inner cavity is divided to at least two chambers by a separating means, and one of the chambers is provided by at least one opening formed in the shell. Preferably a weight member is arranged in the proximity of said opening, and said weight member is provided by a through hole, and arranged in the opening.

The chamber is advantageously provided by at least one further opening formed in the shell.

The chamber is preferably provided by several further openings formed in the shell.

A cross section area of the openings formed in the shell are preferably different.

The opening is arranged in alignment with an axis of the device passing through the opening and the separating means, and a cross section area of an opening formed closer to the opening in the shell is smaller than a cross section area of an opening formed farther from the opening in the shell.

The device has a form substantially of a sphere, and the area of the separating means as measured perpendicularly to the axis is smaller than a greatest internal cross sectional area of any chamber as measured perpendicularly to the axis.

The separating means is hollow and being in fluid communication with chamber, and having an opening formed adjacent the chamber.

Preferably one way valves are arranged in at least one opening of the chamber.

The object above has also been achieved by providing a composite blanket formed on the surface of a storage reservoir containing liquid comprising several cover devices according to the invention in at least one layer formed by several cover devices according to the invention.

BRIEF DESCRIPTION OF THE DRAWINGS

The cover device according to the invention will be disclosed in details as follows by referring to the accompanied drawings, wherein.

DETAILED DESCRIPTION

Figure 1:
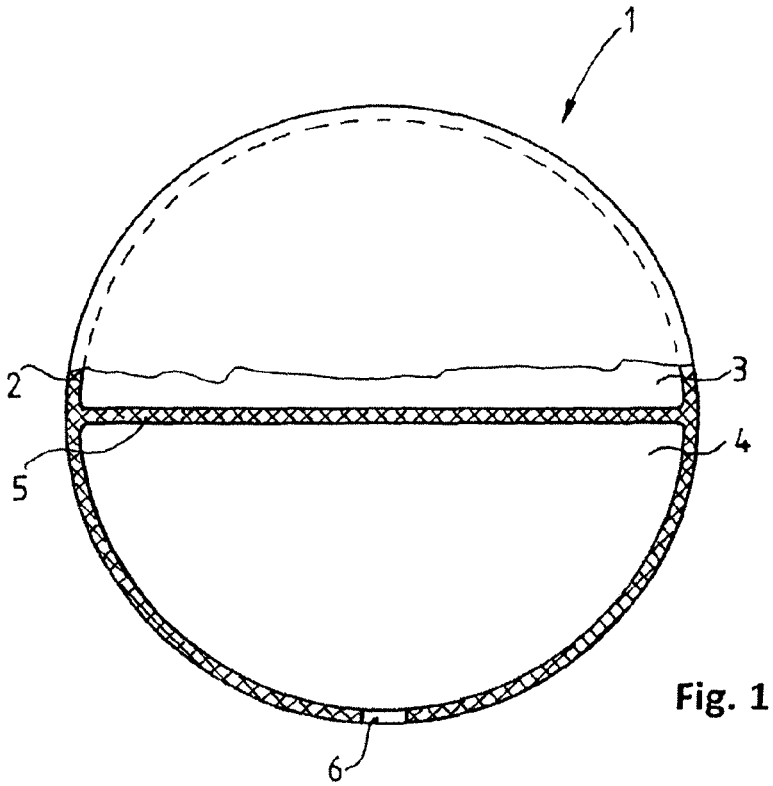
FIG. 1 is a cross sectional view of a preferred embodiment of a self filling cover device according to the present invention.

FIG. 1 is a cross section of an exemplary self filling cover device 1 according to the present invention. The device 1 having a shape e.g. of a sphere or ball in this embodiment consists of a shell 2, the inner cavity of which is divided into two chambers 3, 4 by a separating means 5, e.g a wall. Chamber 3 is sealed gas tightly in respect of the environment, and contains any gas, generally air. Chamber 4 contains air of environmental pressure, because of the presence of at least one opening 6 provided on the shell 2, communicating with the inner cavity of the chamber 4. The shell 2 may preferably be made e.g. of UV stabilized high density polyethylene (HDPE) or any other suitable material, like polypropylene (PP) or polyvinylidene fluoride (PVDF), thus, it may also be produced of many kinds of polymers or copolymers. For some other special applications the shell 2 of the device 1 can be produced as a composite by two or more kinds of material.

It is clear, that a device having such a structure floats on the surface of a liquid having a specific weight higher than the 'specific weight' of the whole structure of the device 1. When a device 1 according to the invention is situated on the surface of a liquid, the latter begins to penetrate into the inner cavity of chamber 4 through the opening 6 sooner or later, while the device 1 is rotating on the surface due to different environmental effects like wind blow or slight rippling of the surface of the liquid, and opening 6 approximates, then goes underneath the surface of the liquid allowing inflow thereof. It also is clear, however, that a weight member 8 fitted preferably in the proximity of the opening 6 results in tending the device 1 to get a position with the opening 6 below the surface of the liquid. The weight member 8 in this embodiment is provided by a through hole 8*a* and arranged in the opening 6 in order to achieve the best effect. Thus, the chamber 4 is filling with liquid up to a level when the internal pressure of the air in chamber 4 becomes equal to the pressure of water penetrating from beneath through the opening 6, and the device 1 starts to float with an axis A being substantially vertical or perpendicular to the surface of the liquid.

Figure 2:
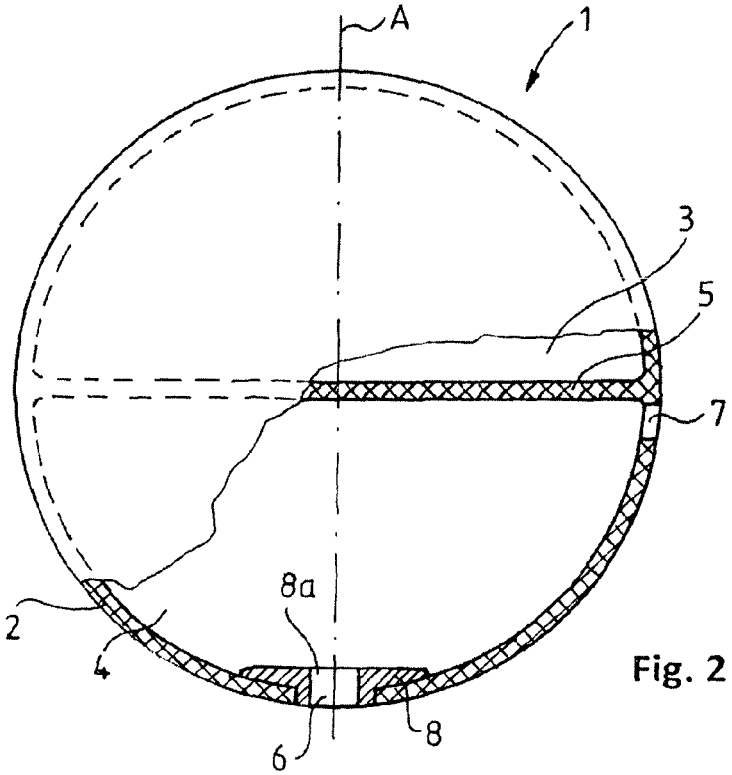
FIG. 2 is a cross sectional view of another preferred embodiment of a self filling cover device according to the present invention.

In order to accelerate above filling process and to make it less aleatory, and to increase the level of the liquid penetrating into chamber 4 for enhancing stability of the device 1, at least one further opening 7 can be arranged on the shell 2 as it can be seen in FIG. 2 depicting a second preferred embodiment of the device 1 according to the invention. This opening 7 is provided adjacent the separating means 5, e.g a wall in order to allow air in the chamber 4 to escape to the full. Thus, the opening 6 is serving only to inflow of the liquid into chamber 4, and opening 7 serves to let the air to exhaust therefrom.

Figure 3:
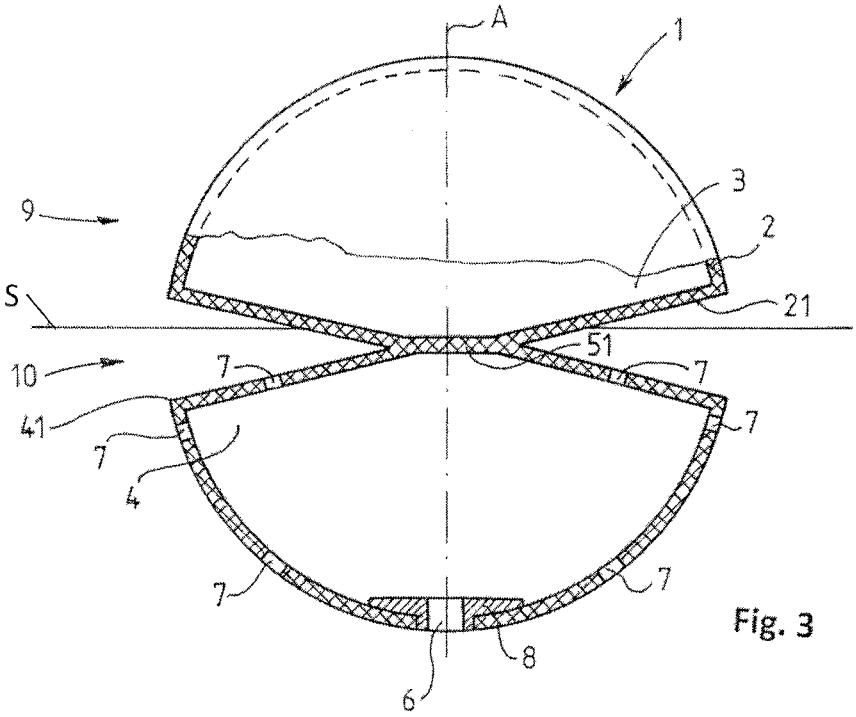
FIG. 3 is a cross sectional view of a further preferred embodiment of a self filling cover device according to the present invention.

In a third preferred embodiment of the device according to the invention, as it can be seen in FIG. 3, the device 1 is shaped by two parts 9, 10 rather than by one part separated by an internal separating means 5, e.g a wall. In this embodiment the parts 9, 10 are attached to each other by a solid central neck 51 portion separating the chambers 3, 4. This form allow the device 1 according to the invention to be more stable, since the device "hangs" on the surface S of the liquid, the latter exerting lifting force directly to a lower surface 21 of the shell 2 delimiting the upper chamber 3. Moreover, there are several openings 7 formed on the shell 2 delimiting the lower chamber 4, in this embodiment.

Figure 4:
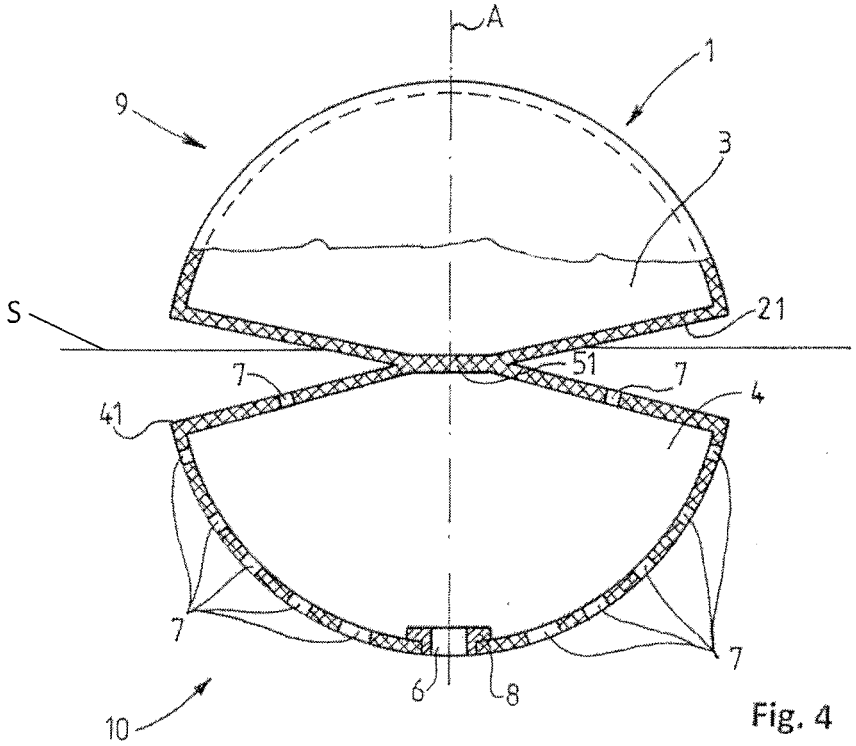
FIG. 4 is a cross sectional view of an advantageous embodiment of a self filling cover device according to the present invention.

It is to be noted, though the number and diameter or adequate size, like cross sectional area, of openings 7 can be chosen arbitrarily, the greater the number of openings 7 the faster the inflow of the liquid into the chamber 4. But choosing greater diameters in case of openings 7 positioned closer to the external edge 41 of the lower part 10 along the surface of the device 1 and therefore to the surface of the liquid, increases a risk of instability in case of strong undulation of the liquid, when the device rocks and openings 7 positioned closer to the edge 41 may be positioned above the surface, because this openings 7 in this position allow the air to inflow the chamber 4, while liquid of equal volume can be removed rapidly from the chamber 4 through opposite opening 7 dove deeply. Therefore, in an advantageous embodiment of the invention, the diameter, or an adequate cross sectional size or area, of each openings 7 is different and decreases while approaching the edge 41 of the lower part 10, as it can be seen in FIG. 4. That is, when the opening 6 is arranged in alignment with an axis A of the device 1 at a lowermost point of the device 1, and said axis A being perpendicular to the separating means 5, e.g a wall, a cross section area of an opening 7 formed closer to the opening 6 in the shell 2 is smaller than a cross section area of an opening 7 formed farther from the opening 6 in the shell 2. The device, in this embodiment, has a form substantially of a sphere, and the area of a separating means 51, e.g a neck portion separating the chambers 3, 4 is smaller, as measured perpendicularly to the axis A, than a greatest internal cross sectional area of any chamber 3, 4 as measured perpendicularly to the axis A.

Figure 5:
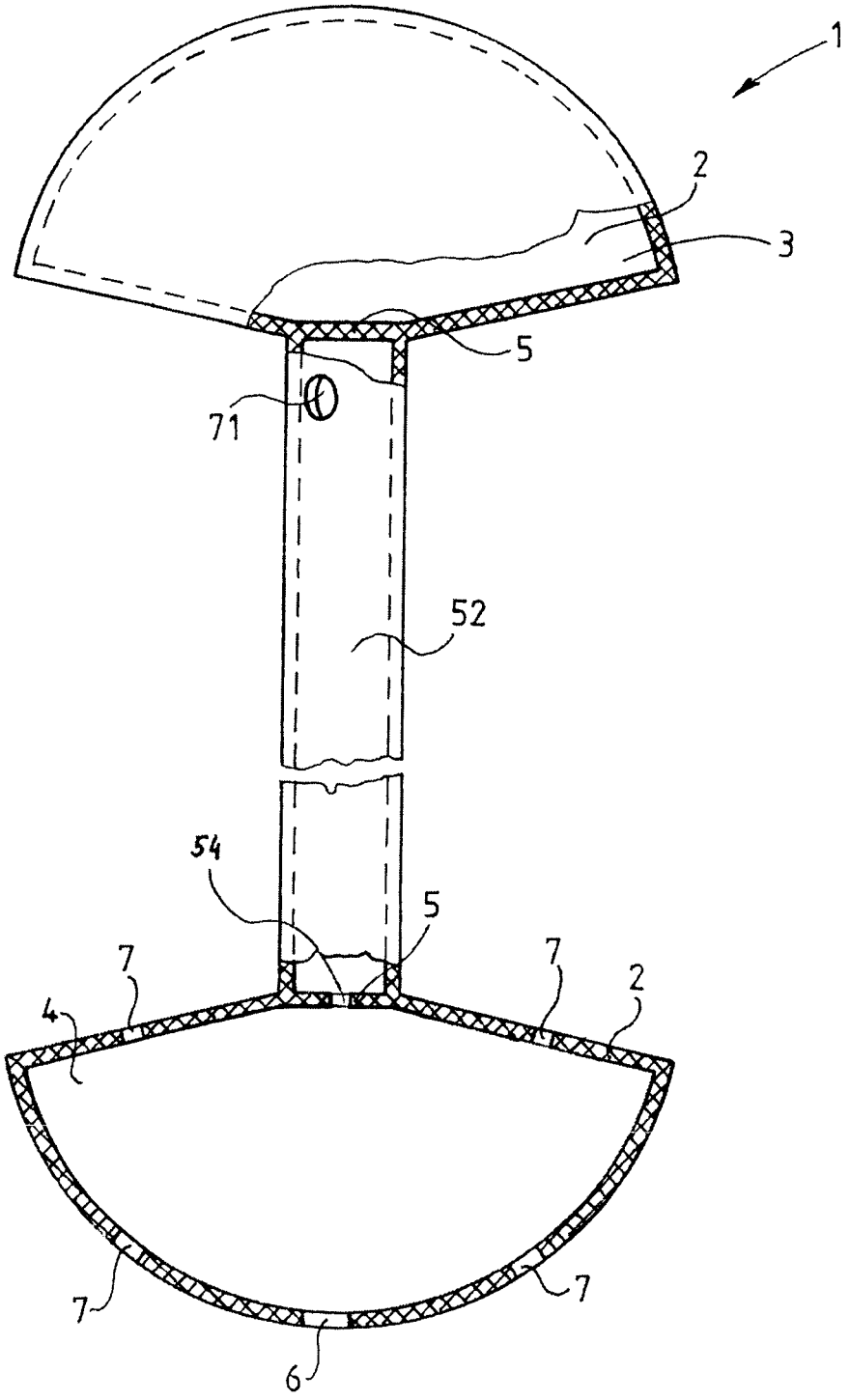
FIG. 5 shows a further preferred embodiment of the invention.

The chambers 3, 4 of the device 1 can be spaced apart by means of using a neck portion 52 as separating means interconnecting the walls 5 of the chambers 3, 4 of a device 1, 11 according to the invention, as depicted in FIG. 5 showing a further preferred embodiment of the invention. In case of i.e. heat insulating purposes at least two, but even several layers formed by devices 1 in close order can be arranged on the surface S of a pond filled with a liquid. However, the devices 1 in the second and subsequent layers placed above the first layer can be filled with the liquid only if its lower chamber 4 is at least partly under the surface S of the liquid. For this, the length of the separating means 51, e.g a neck portion is extended in this embodiment, resulted in a longer separating means 52, e.g a stem interconnecting the respective shells 2 of the chambers 3, 4. Length of the separating means 52, e.g a stem, is determined by the given layer intended to contain a device 1 according to the invention. In the first layer of the devices 1 according to the invention, that is the layer arranged directly on the surface of the liquid in a pond, devices 1 according to any embodiment depicted in FIG. 1, 2, 3 or 4 may adequately be used. In a subsequent or second layer, that is a layer of the devices 1 arranged on the first layer, devices 11 according to the embodiment depicted in FIG. 5 may be used. In a preferred embodiment of the invention the separating means 52 is hollow and being in fluid communication with chamber 4 through a hole 54, and having an opening 71 formed adjacent the chamber 3.

Figure 6:
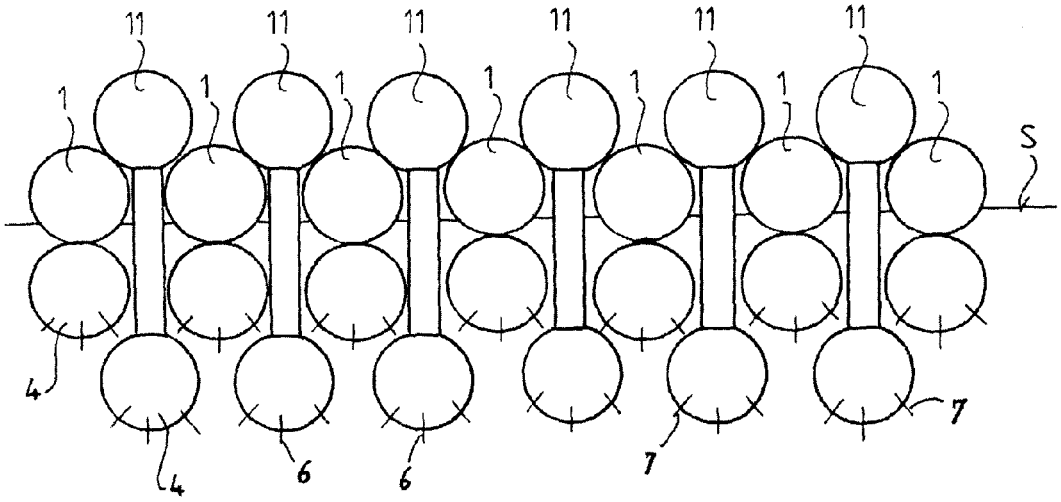
FIG. 6 is a cross sectional view of layers formed by the devices according to the invention arranged on the surface of a pond filled with a liquid.

FIG. 6 is a cross sectional view of layers formed by the devices 1, 11 according to the invention arranged on the surface of a pond filled with a liquid and shows two subsequent layers of devices 1, 11 arranged above each other. Nonetheless, devices 11 may be used in a first layer directly arranged on the surface S as well.

In case of environmental disasters caused by e.g. shipwrecks of tankers allowing the surface of the sea to be bestrewn by several tons of oil, a blanket formed by devices 1 according to the invention can be laid down onto the surface of the water, the openings 6, 7 formed on the shell 2 of the chamber 4 of which can be formed as one way valves known itself for the person skilled in the art, e.g. flap valves formed by partially cutting round the material of the shell 2 at forming the openings 6, 7, for retaining the liquid to be removed along with the devices 1 and/or 11 from the environment. In a preferred embodiment most suitable for this purpose, the chamber 4 may at least partly be filled with a hygroscopic material able for collecting oil or other contaminants.

By placing a sufficient quantity of hollow plastic cover devices 1 according to the invention onto the surface of a liquid, the devices 1 automatically arrange themselves into a close packed formation creating a composite blanket on the surface of a storage reservoir containing liquid. It is clear however, that the geometrical shape of the device 1, 11 can be other than a sphere or spheres separating by a stem 52, although the device has been disclosed by this shape but in an exemplary way only, e.g. a cube or an octahedron etc.

By means of the devices 1 according to the invention disclosed above, floating composite blankets can be formed on surfaces of ponds containing any liquid, providing a highly effective solution to difficult liquid storage problems e.g. in petrochemical and metal treatment industries. The term "composite" here refers to a trait of consisting of several cover devices 1, 11. Although this blanket consists of several devices 1, 11 according to the invention placed side by side on the liquid surface of a pond or a pool, they do not drift into a limited surface area climbing up to each other, or be blown out from the pond or pool in case of strong or stormy winds, and do not require to be produced and transported in a state at least partly filled with a liquid, e.g. water, but it is simple to transport and to install as well as maintenance free. The device 1, 11 according to the invention can be useful for removing oil, detergents and toxic pollutants of water. The device 1, 11 can be applied by different activities of environmental protection such as controlling climate and aqueous biology by using of special sensors mounted on the device 1, 11.

The invention claimed is:

1. A cover device for covering a surface of a liquid in a pond, having a shell (2) defining an inner cavity, and the inner cavity is to be filled at least partly with liquid, wherein the inner cavity is divided into at least two chambers (3, 4) by a separating means (5, 51, 52), and a first chamber (4) of the at least two chambers is provided by a first opening (6) formed in the shell (2), and a weight member (8) is arranged in proximity of said first opening (6), said weight member (8) is provided with a through hole (8*a*), and arranged in the first opening (6) of said shell (2), wherein the device has a form substantially of a sphere, and the area of the separating means (51) as measured perpendicularly to an axis (A) of the device (1), passing through the first opening (6) and the separating means (5, 51, 52), is smaller than a greatest internal cross sectional area of any chamber (3, 4) as measured perpendicularly to the axis (A).

2. The cover device according to claim 1, characterized in that the first chamber (4) is provided by at least one further opening (7) formed in the shell (2) of the first chamber (4).

3. The cover device according to claim 2, characterized in that the first chamber (4) is provided by several further openings (7) formed in the shell (2).

4. The cover device according to claim 3, characterized in that a cross sectional area of a second opening and a third opening of the several further openings (7) formed in the shell (2) are different.

5. The cover device according to claim 4, characterized in that the first opening (6) is arranged in alignment with the axis (A) of the device (1) and a cross sectional area of the second opening (7), formed closer to the first opening (6) in the shell (2), is smaller than a cross sectional area of the third opening (7), formed farther from the first opening (6) in the shell (2).

6. The cover device according to claim 1, characterized in that the separating means (52) is hollow and being in fluid communication with the first chamber (4), and having an opening (71) formed adjacent to a second chamber (3) of the at least two chambers.

7. The cover device according to claim 6, characterized in that one way valves are arranged in at least one of any opening (6, 7) of the first chamber (4).

8. A composite blanket formed on the surface of a storage reservoir containing liquid, characterized by consisting of several cover devices (1, 11) according to any of preceding claims arranged in at least one layer.

* * * * *